US009786227B2

(12) United States Patent
Kim

(10) Patent No.: US 9,786,227 B2
(45) Date of Patent: Oct. 10, 2017

(54) ORGANIC LIGHT EMITTING DISPLAY DEVICE AND DRIVING METHOD THEREOF

(71) Applicant: SAMSUNG DISPLAY CO., LTD., Yongin, Gyeonggi-Do (KR)

(72) Inventor: Yang-Wan Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 210 days.

(21) Appl. No.: 14/644,051

(22) Filed: Mar. 10, 2015

(65) Prior Publication Data

US 2015/0269888 A1 Sep. 24, 2015

(30) Foreign Application Priority Data

Mar. 19, 2014 (KR) ..... 10-2014-0032174

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0819* (2013.01); *G09G 2300/0861* (2013.01); *G09G 2310/0218* (2013.01); *G09G 2310/0283* (2013.01)

(58) Field of Classification Search
CPC ..... G09G 2310/0283; G09G 3/3233; G09G 3/3266
See application file for complete search history.

(56) References Cited

U.S. PATENT DOCUMENTS

2006/0022913 A1* 2/2006 Takayanagi ..... G09G 3/3216 345/76
2006/0097966 A1 5/2006 Choi
2008/0094320 A1* 4/2008 Parikh ..... G09G 3/3233 345/76
2009/0109150 A1* 4/2009 Han ..... G09G 3/3233 345/82
2010/0309187 A1* 12/2010 Kang ..... G09G 3/3233 345/211
2011/0227903 A1* 9/2011 Choi ..... G09G 3/3233 345/212

(Continued)

FOREIGN PATENT DOCUMENTS

KR 10-2006-0041046 A 5/2006
KR 10-2007-0002140 A 1/2007
KR 10-2014-0137504 A 12/2014

*Primary Examiner* — Viet Pham
(74) *Attorney, Agent, or Firm* — Lewis Roca Rothgerber Christie LLP

(57) ABSTRACT

An organic light emitting display device includes: pixels at crossing regions of scan lines and data lines; i (i is a natural number of 2 or more) blocks divided such that each of the blocks includes two or more scan lines; a control driver configured to supply a first control signal to i first control lines coupled, respectively, to the i blocks, and to supply a second control signal to i second control lines coupled, respectively, to the i blocks; a scan driver configured to supply a scan signal to the scan lines; and a data driver configured to supply a data signal to the data lines, wherein the scan driver is configured to supply the scan signals on a block-by-block basis, a sequence of supplying the scan signals being supplied alternately in a first direction and a second direction that is different from the first direction.

17 Claims, 6 Drawing Sheets

(56) References Cited

U.S. PATENT DOCUMENTS

| | | | | |
|---|---|---|---|---|
| 2014/0159999 | A1* | 6/2014 | Gu | G09G 3/3677 345/100 |
| 2014/0176616 | A1* | 6/2014 | Gu | G09G 3/3266 345/690 |
| 2014/0347347 | A1 | 11/2014 | Jeong et al. | |
| 2015/0070256 | A1* | 3/2015 | Gu | G09G 3/3413 345/88 |

* cited by examiner

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2014-0032174, filed on Mar. 19, 2014, in the Korean Intellectual Property Office, the entire contents of which are incorporated herein by reference in their entirety.

BACKGROUND

1. Field

Aspects of embodiments of the present invention relate to an organic light emitting display device and a method of driving the organic light emitting display device.

2. Description of the Related Art

With the development of information technology, the importance of a display device that is a connection medium between a user and information is increased (e.g., magnified). Thus, there is a growing tendency to use flat panel display (FPD) devices such as liquid crystal display (LCD) devices, organic light emitting display devices, or plasma display panels (PDPs).

Among the FPD devices, the organic light emitting display device displays images using organic light emitting diodes (OLEDs) that generate light through the recombination of electrons and holes. The organic light emitting display device has a high response speed and is driven with low power consumption.

SUMMARY

Accordingly, aspects of embodiments of the present invention provide an organic light emitting display device and a method of driving the organic light emitting display device, which are intended to increase (e.g., improve) image quality.

According to an embodiment of the present invention, there is provided an organic light emitting display device including: pixels at crossing regions of scan lines and data lines; i (i is a natural number of 2 or more) blocks divided such that each of the blocks includes two or more scan lines; a control driver configured to supply a first control signal to i first control lines coupled, respectively, to the i blocks, and to supply a second control signal to i second control lines coupled, respectively, to the i blocks; a scan driver configured to supply a scan signal to the scan lines; and a data driver configured to supply a data signal to the data lines, wherein the scan driver is configured to supply the scan signals on a block-by-block basis, a sequence of supplying the scan signals being such that the scan signals are supplied alternately in a first direction and a second direction that is different from the first direction.

The first direction may correspond to a direction from a top to a bottom of each of the blocks, and the second direction may correspond to a direction from the bottom to the top of each of the blocks.

The scan driver may be configured to control the sequence of supplying the scan signals based on one or more frames.

The scan signals may be concurrently supplied on the block-by-block basis, and supply of the scan signals may be sequentially interrupted.

The supply of the scan signals on the block-by-block basis may be interrupted in a sequence of the first direction or the second direction.

The scan driver may include i block drivers to supply the scan signals on the block-by-block basis.

Each of the block drivers may include: stages coupled, respectively, to ones of the scan lines included in an associated block of the blocks; a first switch coupled between a first output terminal of a last stage included in the associated block and a second output terminal coupled to a next block of the blocks; a second switch coupled between a first input terminal of a first stage included in the associated block and a second input terminal coupled to a previous block of the blocks; a third switch coupled between the second output terminal and a first output terminal of the first stage; and a fourth switch coupled between the second input terminal and a first input terminal of the last stage.

The first switch and the second switch may be concurrently turned on or off, and the third switch and the fourth switch may be concurrently turned on or off, and an ON period of the first switch may not overlap an ON period of the third switch.

The first switch and the second switch may be turned on when the supply of the scan signals is interrupted in the first direction, and the third switch and the fourth switch may be turned on when the supply of the scan signals is interrupted in the second direction.

The control driver and the scan driver may be integrated into one driver, and the block driver may further include a first control stage and a second control stage for generating the first control signal and the second control signal, respectively.

The control driver may be configured to sequentially supply the first control signal to the i first control lines, and to sequentially supply the second control signal to the i second control lines in such a way as to overlap the first control signal during a period.

The scan signal may be set to a voltage at which a transistor in each of the pixels is turned on, and the first control signal and the second control signal may be set to voltages at which transistors in each of the pixels are turned off.

The first control signal may be supplied to an i-th block after the scan signal has been concurrently supplied to scan lines at the i-th block, the second control signal may be supplied to the i-th block after the first control signal has been supplied, and supply of the second control signal may be interrupted after supply of the first control signal has been interrupted.

The data driver may be configured to supply the data signal to the data lines during a period when the first control signal overlaps the second control signal, and to supply a reference power as the data signal during a remaining period.

At least one pixel at each of the blocks may include: an organic light emitting diode; a first transistor configured to control a current that is supplied to the organic light emitting diode from a first power source coupled to a first electrode of the first transistor, in response to a voltage applied to a first node; a second transistor coupled between the first node and the data line, and configured to be turned on when the scan signal is supplied; a third transistor coupled between the first electrode of the first transistor and the first power source, the third transistor configured to be turned off when the first control signal is supplied and to be turned on in other cases; a fourth transistor coupled between a second electrode of the first transistor and an anode electrode of the organic light emitting diode, the fourth transistor configured to be turned off when the second control signal is supplied and to be turned on in other cases; a fifth transistor coupled between the anode electrode of the organic light emitting diode and an initialized power source, and configured to be turned on when the scan signal is supplied; and a first capacitor and a second capacitor coupled in series between the first node and the first power source, wherein a second node that is a common terminal of the first and second capacitors is electrically coupled to the first electrode of the first transistor.

According to another embodiment of the present invention there is provided, a method of driving an organic light emitting display device including i (i is a natural number of 2 or more) blocks, each of the blocks including a plurality of pixels, the method including: concurrently compensating for a threshold voltage of a driving transistor at each of the pixels of each of the blocks; supplying scan signals to each of the blocks and storing a voltage corresponding to a data signal in the pixels of each of the blocks; and emitting light from the pixels of each of the blocks, wherein the scan signals are supplied to the blocks alternately in a first direction and a second direction that is different from the first direction.

The first direction may correspond to a direction from a top to a bottom of each of the blocks, and the second direction may correspond to a direction from the bottom to the top of each of the blocks.

A sequence of supplying the scan signals may be changed to the first direction and the second direction based on one or more frames.

The scan signals may be concurrently supplied to scan lines included in each of the blocks, and supply of the scan signals may be sequentially interrupted.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout. Further, when a first element is referred to as being coupled or connected to a second element, the first element may be directly coupled or connected to the second element or may be indirectly coupled or connected to the second element through one or more intervening elements.

DETAILED DESCRIPTION

Hereinafter, embodiments of the present invention will be described in detail with reference to FIGS. 1 to 8.

Figure 1:
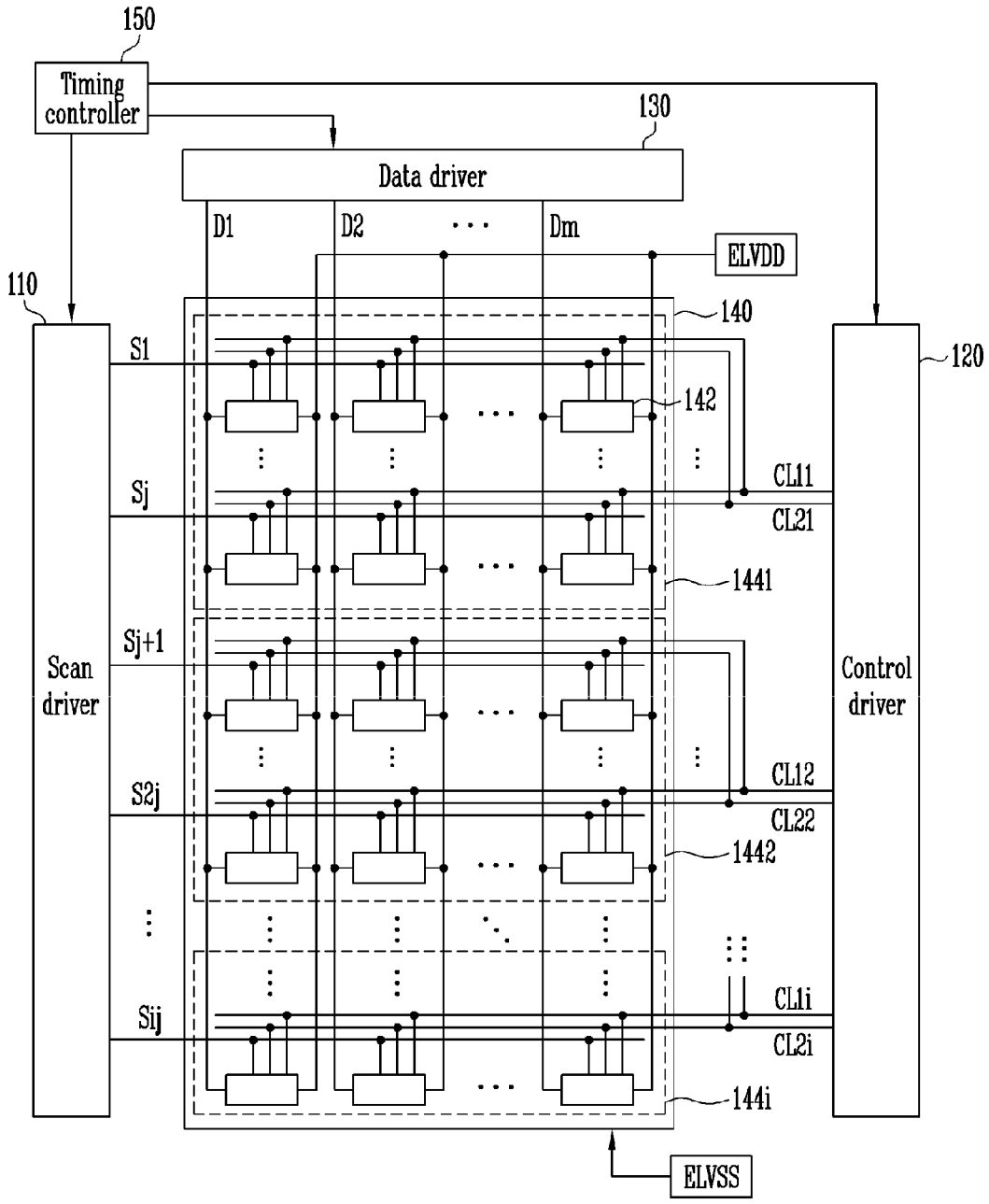
FIG. 1 is a view illustrating an organic light emitting display device according to an embodiment of the present invention.

FIG. 1 is a view illustrating an organic light emitting display device according to an embodiment of the present invention.

Referring to FIG. 1, the organic light emitting display device according to the embodiment of the present invention includes i (i is the natural number of 2 or more) blocks 1441 to 144*i*, each block having a plurality of pixels, pixels 142 being at (e.g., positioned at) a region (e.g., at crossing regions) defined by scan lines S1 to Sij and data lines D1 to Dm, a scan driver 110 configured to drive the scan lines S1 to Sij, a control driver 120 configured to drive first control lines CL11 to CL1*i* and second control lines CL21 to CL2*i* which are formed at respective blocks, a data driver 130 configured to drive the data lines D1 to Dm, and a timing controller 150 configured to control the drivers 110, 120 and 130.

A display area 140 includes i blocks 1441 to 144*i*. That is, the display area 140 is divided into two or more blocks 1441 to 144*i*, and the pixels 142 included in the respective blocks 1441 to 144*i* concurrently (e.g., simultaneously) undergo a threshold-voltage compensating step. If the threshold voltage of the pixels 142 is compensated for on a block basis, it is possible to decrease (e.g., minimize) a time to compensate for the threshold voltage, in addition to reliably compensating for the threshold voltage of the pixels 142. In embodiments of the present invention, each of the blocks 1441 to 144*i* includes at least two scan lines.

The respective blocks 1441 to 144*i* are coupled to different first control lines (associated ones of CL11 to CL1*i*) and to different second control lines CL21 to CL2*i*. Thus, the i first control lines CL11 to CL1*i* and the i second control lines CL21 to CL2*i* are formed at the display area (e.g., a display unit or a display region) 140. The pixels 142 formed at the i-th block 144*i* are coupled to the i-th first control line CL1*i* and the i-th second control line CL2*i* in common.

The control driver 120 is configured to sequentially provide first control signals to the first control lines CL11 to CL1*i*, and to sequentially provide second control signals to the second control lines CL21 to CL2*i*. In this regard, the second control signal is provided to the i-th second control line CL2*i* after the first control signal has been provided to the i-th first control line CL1*i*, and the supply of the second control signal is interrupted after the supply of the first control signal has been interrupted. The first and second control signals provided to the first control lines CL11 to CL1*i* and the second control lines CL21 to CL2*i* are set to a voltage (e.g. a high voltage) at which a transistor included in each of the pixels 142 may be turned off.

The scan driver 110 is configured to provide scan signals to the scan lines S1 to Sij. Here, the scan driver 110 provides the scan signal on a block-by-block basis. For instance, before the first control signal is provided to the first control line CL11 located at a first position at the first block 1441, the scan driver 110 concurrently (e.g., simultaneously) provides the scan signal to the scan lines S1 to Sj located at the first block 1441. The scan driver 110 maintains the scan signal provided to the scan lines S1 to Sj until the first control signal provided to the first control line CL11 located at the first position overlaps the second control signal provided to the second control line CL21 located at the first position. Subsequently, the scan driver 110 sequentially interrupts the supply of the scan signal to the scan lines S1 to Sj located at the first block 1441 while charging or supplying the pixels 142 with a voltage corresponding to a desired data signal.

In this regard, the sequence of providing the scan signal to the scan lines S1 to Sj, namely; the sequence of interrupting the supply of the scan signal is established in a first direction or a second direction that is different from the first direction. For instance, the scan driver 110 may control the sequence of interrupting the supply of the scan signal, based on at least one frame, alternately in the first direction or second direction. This will be described below in detail. In addition, the first direction corresponds to a direction from a top to a bottom of the block, while the second direction corresponds to a direction from the bottom to the top of the block. Further, the scan signal is set to a voltage (e.g. a low voltage) at which the transistor included in the pixels 142 may be turned on.

The data driver 130 is configured to provide a data signal to the data lines D1 to Dm in response to the supply of the scan signal being sequentially interrupted. Then, the data signal is provided to the pixels 142 selected by the scan signal. Further, the data driver 130 provides the voltage of a reference power to the data lines D1 to Dm during at least some of a period when no data signal is provided. Here, the reference power may be a voltage within the voltage range of the data signal.

The pixels 142 are located at the region (e.g., crossing regions) defined by the scan lines S1 to Sij and the data lines D1 to Dm. The pixels 142 generate light of a set luminance (e.g., a predetermined luminance) while controlling a current flowing from a first power source ELVDD through an OLED to a second power source ELVSS in response to the data signal.

Although it is illustrated in the above description that the first control lines CL11 to CL1*i* and the second control lines CL21 to CL2*i* are driven by the control driver 120, the present invention is not limited thereto. For example, the first control lines CL11 to CL1*i* and the second control lines CL21 to CL2*i* may be driven by the scan driver 110.

The timing controller 150 is configured to control the scan driver 110, the control driver 120 and the data driver 130.

Figure 2:
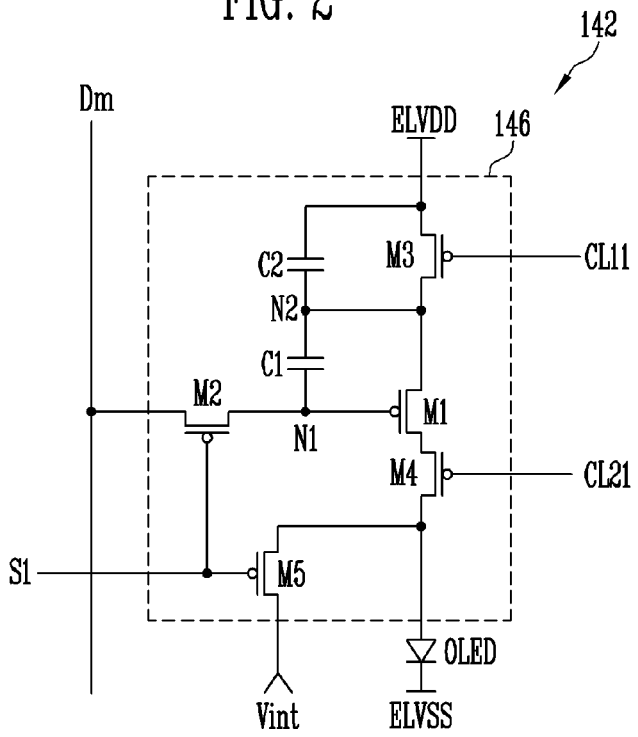
FIG. 2 is a view illustrating a pixel according to an embodiment of the present invention.

FIG. 2 is a view illustrating the pixel according to the embodiment of the present invention illustrated in FIG. 1. For the convenience of description, FIG. 2 illustrates the pixel that is coupled to the m-th data line Dm and the first scan line S1.

Referring to FIG. 2, the pixel 142 according to the present embodiment of the present invention includes an OLED, and a pixel circuit 146 controlling the current that is provided to the OLED.

An anode electrode of the OLED is coupled to the pixel circuit 146, while a cathode electrode thereof is coupled to the second power source ELVSS. Such an OLED generates light of a set luminance (e.g., a predetermined luminance) depending on the current provided from the pixel circuit 146. In order to allow current to flow in the OLED, the second power source ELVSS may be set to a voltage that is lower than that of the first power source ELVDD.

The pixel circuit 146 is configured to control the current that is provided to the OLED, in response to the data signal. To this end, the pixel circuit 146 is provided with first to fifth transistors M1 to M5, a first capacitor C1 and a second capacitor C2.

A first electrode of the first transistor M1 (i.e., the driving transistor) is coupled via the third transistor M3 to the first power source ELVDD, while a second electrode thereof is coupled via the fourth transistor M4 to the anode electrode of the OLED. Further, a gate electrode of the first transistor M1 is coupled to a first node N1. The first transistor M1 is configured to control the current flowing from the first power source ELVDD via the OLED to the second power source ELVSS, depending on the voltage applied to the first node N1.

A first electrode of the second transistor M2 is coupled to the data line Dm, while a second electrode thereof is coupled to the first node N1. Further, a gate electrode of the second transistor M2 is coupled to the scan line S1. When the scan signal is provided to the scan line S1, such a second transistor M2 is turned on to electrically couple the data line Dm to the first node N1.

A first electrode of the third transistor M3 is coupled to the first power source ELVDD, while a second electrode thereof is coupled to the first electrode of the first transistor M1. Further, a gate electrode of the third transistor M3 is coupled to the first control line CL11. When the first control signal is provided to the first control line CL11, such a third transistor M3 is turned off. In other cases, the third transistor M3 is turned on.

A first electrode of the fourth transistor M4 is coupled to the second electrode of the first transistor M1, while a second electrode thereof is coupled to the anode electrode of the OLED. Further, a gate electrode of the fourth transistor M4 is coupled to the second control line CL21. When the second control signal is provided to the second control line CL21, such a fourth transistor M4 is turned off. In other cases, the fourth transistor M4 is turned on.

A first electrode of the fifth transistor M5 is coupled to the anode electrode of the OLED, while a second electrode thereof is coupled to an initialized power source Vint. Further, a gate electrode of the fifth transistor M5 is coupled to the scan line S1. When the scan signal is provided to the scan, line S1, such a fifth transistor M5 is turned on to supply the voltage of the initialized power source Vint to the anode electrode of the OLED. In this context, the initialized power source Vint is set to a low voltage at which the OLED may be turned off.

The first capacitor C1 and the second capacitor C2 are coupled in series between the first node N1 and the first power source ELVDD. Further, a second node N2 that is a common terminal of the first capacitor C1 and the second capacitor C2 is electrically coupled to the first electrode of the first transistor M1. The first and second capacitors C1 and C2 store a voltage corresponding to the threshold voltage of the first transistor M1 and the data signal.

Figure 3:
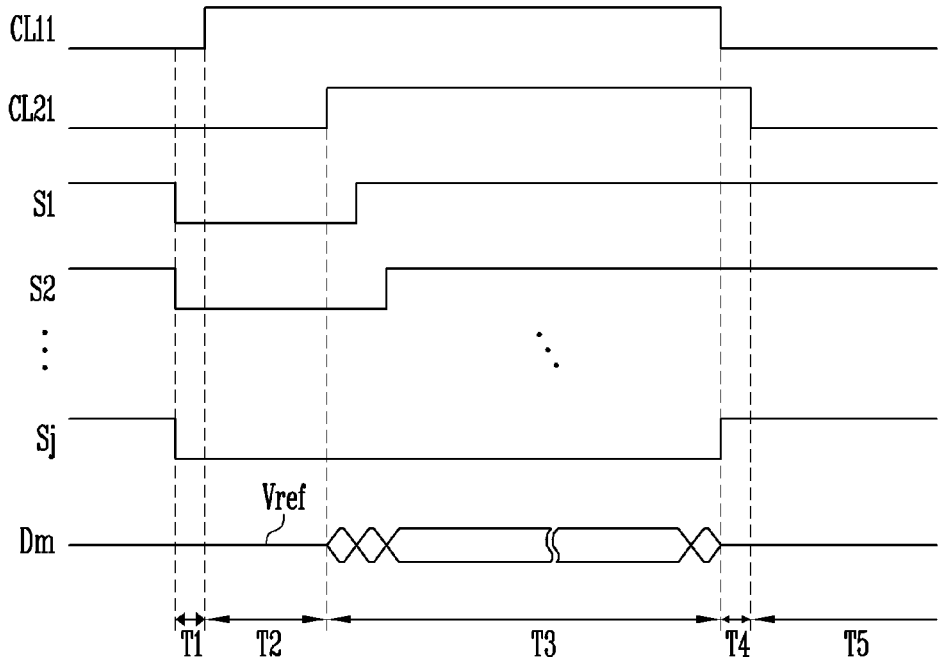
FIG. 3 is a waveform diagram illustrating a method of driving the pixel shown in FIG. 2, according to a first embodiment of the present invention.

FIG. 3 is a waveform diagram illustrating a method of driving the pixel shown in FIG. 2, according to a first embodiment. For the convenience of description, FIG. 3 shows the driving waveform provided to the first block 1441.

Referring to FIG. 3, the first control signal is provided to the first control line CL11 located at the first block 1441 during a second period T2 and a third period T3, while the second control signal is provided to the second control line CL21 during a third period T3 and a fourth period T4. Further, reference power Vref is supplied to the data lines D1 to Dm during the first period T1 and the second period T2.

In the first period T1, the scan signal is concurrently (e.g., simultaneously) provided to the scan lines S1 to Sj. When the scan signal is provided to the first scan line S1, the second transistor M2 and the fifth transistor M5 are turned on.

When the fifth transistor M5 is turned on, the voltage of the initialized power source Vint is supplied to the anode electrode of the OLED. Then, a parasitic capacitor of the OLED is discharged, so that the OLED is initialized.

When the second transistor M2 is turned on, the data line Dm is electrically coupled to the first node N1. As such, when the data line Dm is electrically coupled to the first node N1, the voltage of the reference power Vref is supplied to the first node N1. Since the reference power Vref is set to a specific voltage within the data signal, the first transistor M1 is set to be turned on. Then, a current (e.g., a predetermined current) flows from the first power source ELVDD through the first transistor M1, the fourth transistor M4 and the fifth transistor M5 to the initialized power source Vint.

Since the first transistor M1 is set to a turn-on state, namely, an on-bias state during the first period T1, it is possible to display an image of uniform luminance. That is, the first transistor M1 included in each of the pixels 142 is problematic in that it is set to have non-uniform voltage characteristics in response to a grayscale of a previous period, so that the pixels may not display an image of desired luminance. However, according to embodiments of the present invention, during the first period T1, the driving transistor of each of the pixels 142 included in the first block 1441 is initialized to assume the on-bias state, so that it is possible to display a uniform image. Further, since the current flowing through the first transistor M1 during the first period T1 is supplied to the initialized power source Vint, the OLED maintains a non-emitting state.

In the second period T2, the first control signal is provided to the first control line CL11. When the first control signal is provided to the first control line CL11, the third transistor M3 is turned off. When the third transistor M3 is turned off, the first power source ELVDD is electrically disconnected from the second node N2. In this case, the first node N1 maintains the voltage of the reference power Vref.

Thus, in the second period T2, a current (e.g., a predetermined current) flows from the second node N2 through the first transistor M1, the fourth transistor M4 and the fifth transistor M5 to the initialized power source Vint. Then, the voltage of the second node N2 decreases from the voltage of the first power source ELVDD to a voltage that is the sum of the reference power Vref and the threshold voltage of the first transistor M1. When the voltage of the second node N2 is a voltage that is the sum of the reference power Vref and the threshold voltage of the first transistor M1, the first transistor M1 is turned off. Then, the first capacitor C1 is charged with the voltage corresponding to the threshold voltage of the first transistor M1.

In the third period T3, the scan signal is concurrently (e.g., simultaneously) provided to the scan lines S1 to Sj, and the supply is sequentially interrupted. For example, the supply of the scan signal from the first scan line S1 to the j-th scan line Sj may be sequentially interrupted. Further, the second control signal is provided to the second control line CL21 during the third period T3, so that the fourth transistor M4 included in each of the pixels 142 of the first block 1441 is turned off.

When the scan signal is concurrently (e.g., simultaneously) provided to the scan lines S1 to Sj during the third period T3, the second transistor M2 and the fifth transistor M5 included in the respective pixels 142 located at the first horizontal line and the j-th horizontal line are turned on. In this case, the data signal corresponding to the pixel 142 coupled to the first scan line S1 is provided to the data line Dm.

The data signal provided to the data line Dm is provided to the first node N1 of each of the pixels 142 located at the first to j-th horizontal lines. When the data signal is provided to the first node N1, the voltage of the first node N1 is changed from the voltage of the reference power Vref to the voltage of the data signal. In this case, the voltage of the second node N2 is also changed depending on a variation in voltage of the first node N1. For example, the voltage of the second node N2 is changed into a set voltage (e.g., a predetermined voltage) depending on a capacitance ratio of the first capacitor C1 and the second capacitor C2. Then, the first capacitor C1 is charged with the voltage corresponding to the threshold voltage of the first transistor M1 and the data signal. After the first capacitor C1 of each of the pixels 142 included in the first block 142 is charged with the voltage of the data signal corresponding to the first horizontal line, the supply of the scan signal to the first scan line S1 is interrupted. When the supply of the scan signal to the first scan line S1 is interrupted, each of the pixels 142 located at the first horizontal line maintains the voltage stored in the first capacitor C1.

Subsequently, the data signal corresponding to the pixel 142 coupled to the second scan line S2 is provided to the data lines D1 to Dm. Then, the voltage of the data signal corresponding to the second horizontal line is stored in the first capacitor C1 of each of the pixels 142 located at the second to j-th horizontal lines. After the voltage of the data signal corresponding to the second horizontal line is stored in the first capacitor C1, the supply of the scan signal to the second scan line S2 is interrupted. Thereby, each of the pixels 142 located at the second horizontal line maintains the voltage stored in the first capacitor C1. Likewise, the pixels 142 located at the third to j-th horizontal lines repeat the above-mentioned process, thus storing a voltage corresponding to a desired data signal.

In the fourth period T4, the supply of the first control signal to the first control line CL1 is interrupted, so that the third transistor M3 is turned on. When the third transistor M3 is turned on, the second node of each of the pixels 142 of the first block 1441 is electrically coupled to the first power source ELVDD. Since the first node N1 is set to a floating state, the first capacitor C1 stably maintains the voltage charged during the previous period.

In the fifth period T5, the supply of the second control signal to the second control line CL21 is interrupted, so that the fourth transistor M4 is turned on. When the fourth transistor M4 is turned on, the first transistor M1 is electrically coupled to the anode electrode of the OLED. Then, the first transistor M1 controls the current that is supplied to the OLED depending on the voltage stored in the first capacitor C1.

In practice, the pixels 142 included in the first block 1441 generate light of a set luminance (e.g., a predetermined luminance) in response to the data signal while repeating the above-mentioned process. During the fifth period T5, when the pixels of the first block 1441 emit light, the first control signal and the second control signal are provided to the first control line CL12 and the second control line CL22 which are coupled to the second block 1442, so that the pixels 142 included in the second block 1442 generate light of a set luminance (e.g., a predetermined luminance) while repeating the above-mentioned process. Likewise, the pixels 142 included in the third to i-th blocks 1443 to 144*i* are driven through the above-mentioned process.

Figure 4A:
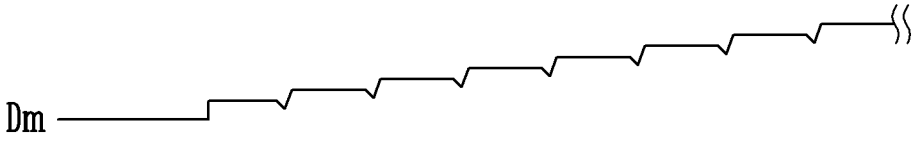
FIG. 4A is a view illustrating a change in voltage of a data line according to the driving waveform shown in FIG. 3.
Figure 4B:
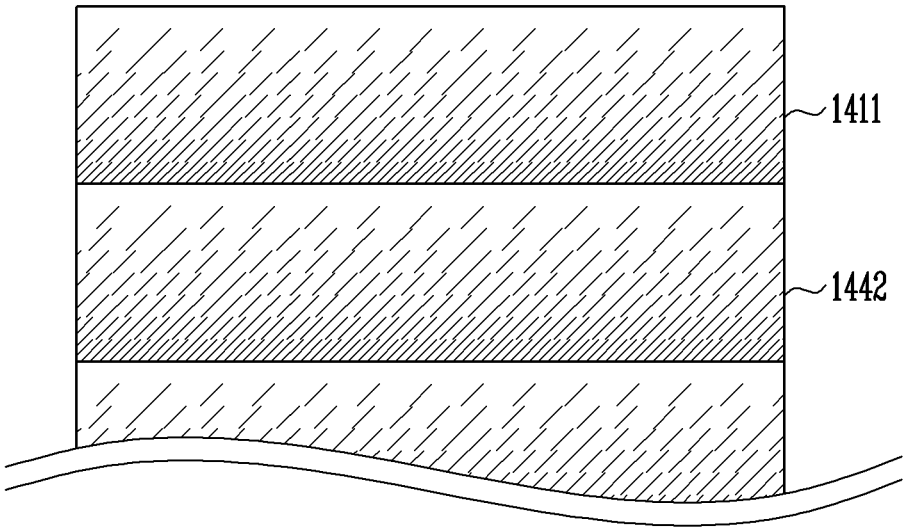
FIG. 4B is a view schematically illustrating the luminance of a block according to the driving waveform shown in FIG. 3.

When the pixels 142 are driven by the driving method according to the first embodiment of the present invention, the respective blocks 1441 to 144*i* may display non-uniform images. In other words, when the supply of the scan signal is sequentially interrupted, an increase in voltage of the data lines D1 to Dm may be caused by the parasitic capacitor. For example, when the supply of the scan signal to the scan lines S1 to Sj is sequentially interrupted, as shown in FIG. 4A, the voltage of the data line Dm is sequentially increased. Thus, even when the same data signal is provided to the pixels 142, the luminance becomes reduced in a direction from the top to the bottom of the block as shown in FIG. 4B.

Figure 5:
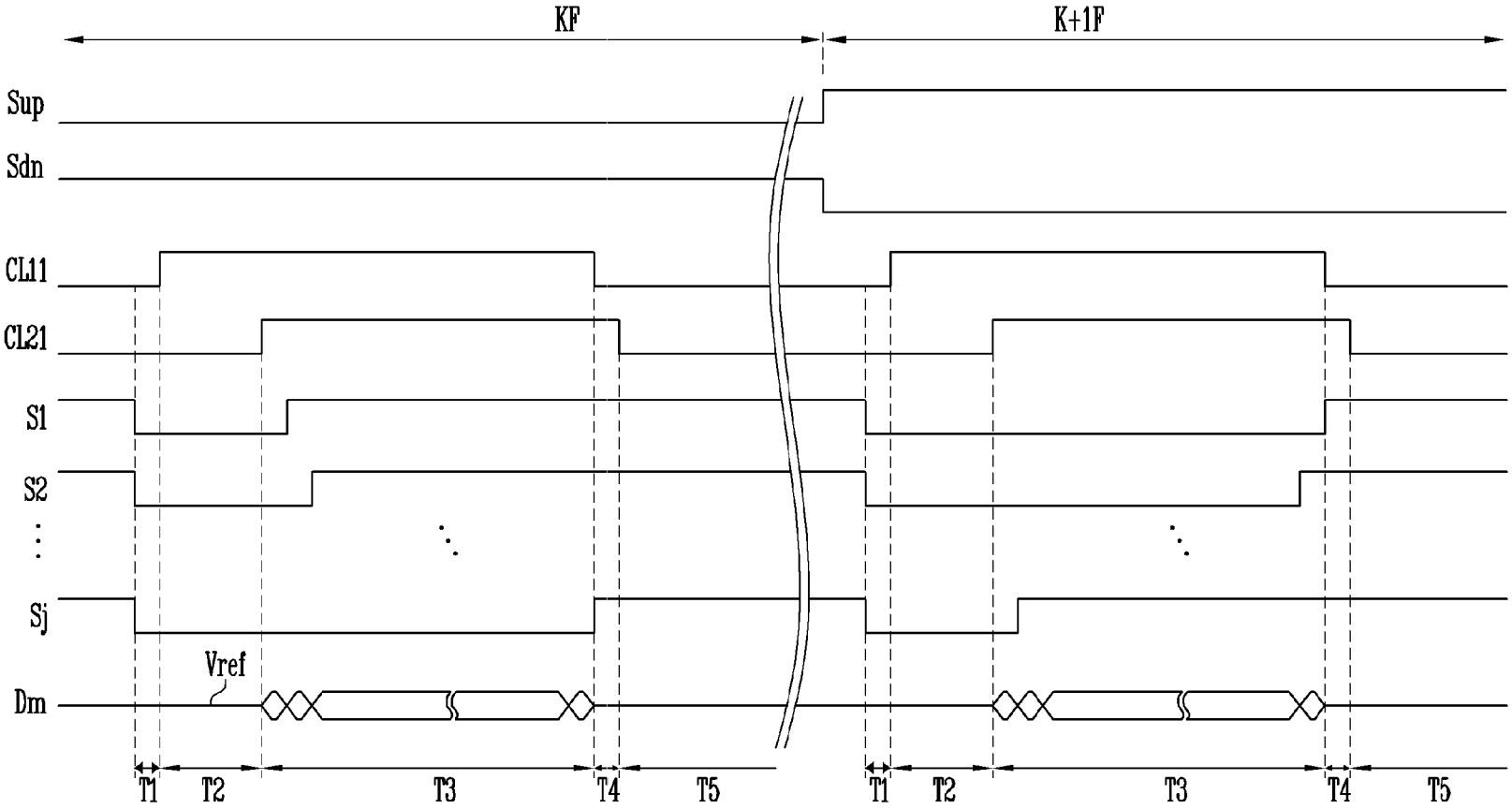
FIG. 5 is a waveform diagram illustrating a driving method according to a second embodiment of the present invention.

FIG. 5 is a waveform diagram illustrating a driving method according to a second embodiment of the present invention.

Referring to FIG. 5, in the second embodiment of the present invention, the sequence of providing the scan signal (i.e., the sequence of interrupting the supply of the scan signal) is established in a reversed order from that of a previous frame, based on (e.g., after) at least one frame. For example, the supply of the scan signal is sequentially interrupted in a first direction during a k-th frame kF, and is sequentially interrupted in a second direction during a (k+1)-th frame k+1F.

That is, according to the second embodiment of the present invention, the sequence of providing the scan signal is changed based on (e.g., after) at least one frame, so that it is possible to display an image of almost or substantially uniform luminance. In other words, increments in voltage of the data lines D1 to Dm are approximately equalized depending on a change in the supply sequence of the scan signal, thus being capable of displaying the image of uniform luminance. The driving method according to the second embodiment of the present invention remains the same as the driving method shown in FIG. 3 except for the supply sequence of the scan signal, based on (e.g., after) at least one frame. Therefore, the detailed description of the driving method according to the second embodiment will be omitted herein.

Figure 6:
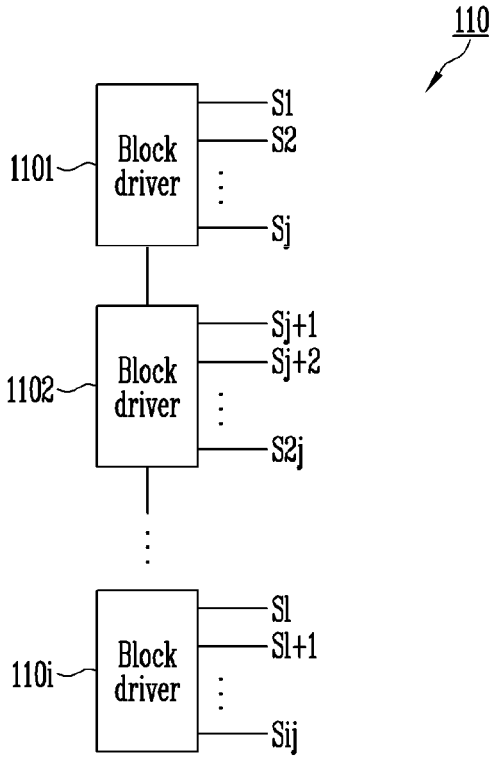
FIG. 6 is a view illustrating a scan driver according to an embodiment of the present invention.

FIG. 6 is a view illustrating a scan driver according to an embodiment of the present invention.

Referring to FIG. 6, the scan driver 110 according to the present embodiment of the present invention is provided with i block drivers 1101 to 110*i* corresponding to the respective blocks. The first block driver 1101 is configured to provide the scan signal to the scan lines S1 to Sj formed at the first block 1441, and the second block driver 1102 is configured to provide the scan signal to the scan lines Sj+1 to S2*j* formed at the second block 1442. Likewise, the i-th block driver 1101 provides the scan signal to the scan lines Sl to Sij formed at the i-th block 144*i*.

Figure 7:
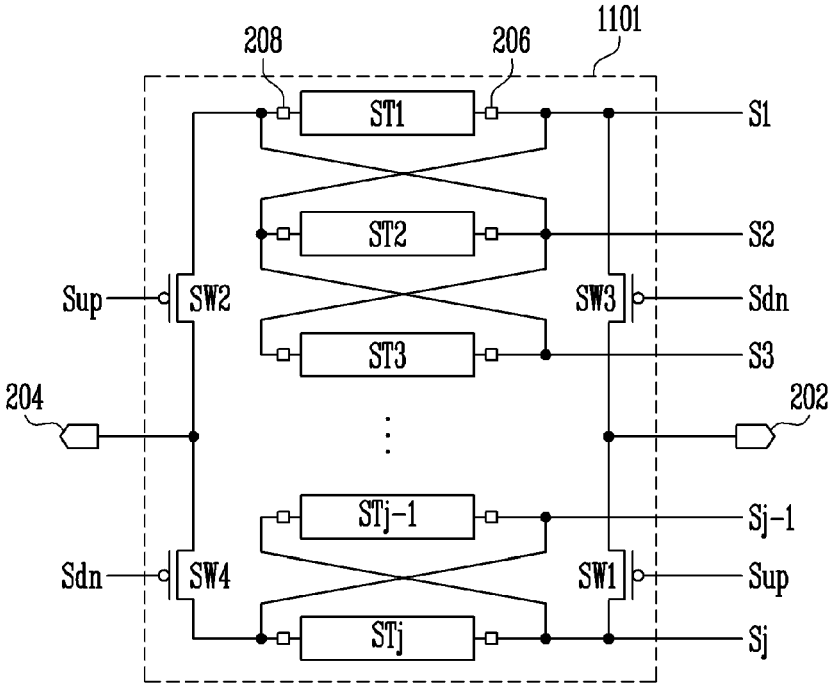
FIG. 7 is a view illustrating an embodiment of the block driver shown in FIG. 6.

FIG. 7 is a view illustrating an embodiment of a block driver shown in FIG. 6. For the convenience of description, FIG. 7 illustrates the first block driver 1101.

Referring to FIG. 7, the first block driver 1101 according to the present embodiment of the present invention is provided with stages ST1 to STj coupled to the scan lines S1 to Sj, respectively, and to first to fourth switches SW1 to SW4.

Each of the stages ST1 to STj is coupled to any one of the scan lines S1 to Sj. The stages ST1 to STj are configured to provide the scan signal to the scan lines S1 to Sj as shown in FIG. 5, in response to control signals. In addition, each of the stages ST1 to STj is provided with a first input terminal 208 and a first output terminal 206. A sampling signal is input from an outside to the first input terminal 208, while the sampling signal is output from the first output terminal 206 to the outside.

The first switch SW1 is coupled between the first output terminal 206 of the j-th stage STj and a second output terminal 202. For example, the second output terminal 202 is the terminal that provides the sampling signal to a next block driver 1102. The first switch SW1 is turned on when a first direction signal Sup is input. When the first switch SW1 is turned on, an output signal (or scan signal) is provided from the j-th stage STj to a second input terminal of a next block.

The second switch SW2 is coupled between the first input terminal 208 of the first stage ST1 and the second input terminal 204. In this context, the second input terminal 204 is the terminal that receives the sampling signal from a previous block driver or from the outside. The second switch SW2 is turned on when the first direction signal Sup is input. When the second switch SW2 is turned on, the sampling signal is provided from the previous block driver or from the outside to the first stage ST1.

The third switch SW3 is coupled between the first output terminal 206 of the first stage ST1 and the second output terminal 202. Such a third switch SW3 is turned on when the second direction signal Sdn is input. When the third switch SW3 is turned on, the output signal is provided from the first stage ST1 to the second input terminal of the next block.

The fourth switch SW4 is coupled between the first input terminal 208 of the j-th stage STj and the second input terminal 204. Such a fourth switch SW4 is turned on when the second direction signal Sdn is input. When the fourth switch SW4 is turned on, the sampling signal is provided from the previous block driver or from the outside to the j-th stage STj.

The first direction signal Sup and the second direction signal Sdn are alternately provided such that they do not overlap each other, based on (e.g., during) at least one frame. In the case of providing the first direction signal Sup, the sequence of providing the scan signal is set to the first direction. In contrast, in the case of providing the second direction signal Sdn, the sequence of providing the scan signal is set to the second direction.

An operation will be described below with reference to FIGS. 5 and 7. First, the first direction signal Sup is provided during the k-th frame kF period, so that the first switch SW1 and the second switch SW2 are turned on. When the second switch SW2 is turned on, the sampling signal is provided from the second input terminal 204 to the first stage ST1. When the first switch SW1 is turned on, the sampling signal is provided from the j-th stage STj through the second output terminal 202 to the next block driver 1102. In this case, the sampling signal is provided sequentially from the first stage ST1 to the j-th stage STj, so that the supply of the scan signal is interrupted in the sequence from the first scan line S1 to the j-th scan line Sj.

Subsequently, the second direction signal Sdn is provided during the (k+1)-th frame (k+1F) period, so that the third switch SW3 and the fourth switch SW4 are turned on. When the fourth switch SW4 is turned on, the sampling signal is provided from the second input terminal 204 to the j-th stage STj. When the third switch SW3 is turned on, the sampling signal is provided from the first stage ST1 through the second output terminal 202 to the next block driver 1102. In this case, the sampling signal is sequentially provided from the j-th stage STj to the first stage ST1. Thereby, the supply of the scan signal is interrupted in the sequence from the j-th scan line Sj to the first scan line S1.

Figure 8:
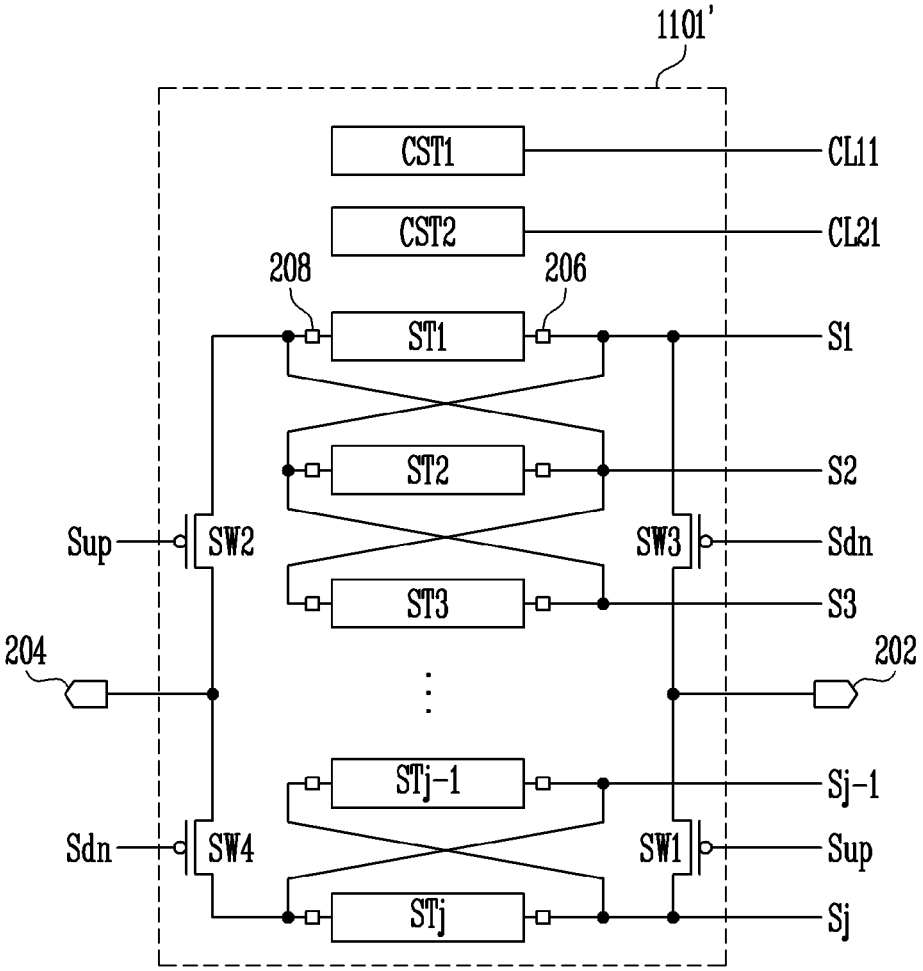
FIG. 8 is a view illustrating another embodiment of the block driver shown in FIG. 6.

FIG. 8 is a view illustrating another embodiment of the block driver shown in FIG. 6. Components common to FIGS. 7 and 8 will carry the same reference numerals, and the detailed description thereof will be omitted herein.

Referring to FIG. 8, a first block driver 1101' according to another embodiment of the present invention includes a first control stage CST1 generating a first control signal, and a second control stage CST2 generating a second control signal.

The first control stage CST1 generates a first control signal in response to the control signal that is provided from the outside or the previous block driver, and provides the generated first control signal to the first control line CL11.

The second control stage CST2 generates a second control signal in response to the control signal that is provided from the outside or the previous block driver, and provides the generated second control signal to the second control line CL21. In addition, when the first control stage CST1 and the second control stage CST2 are included in the block driver 1101', the control driver 120 is omitted.

For the convenience of description, the transistors are illustrated as PMOS in the above description, but the present invention is not limited thereto. In other words, the transistors may be formed as NMOS.

Further, according to embodiments of the present invention, the OLED may generate red, green, blue or white light depending on a current. When the OLED generates the white light, it is possible to implement a color image using an additional color filter.

By way of summation and review, the organic light emitting display device includes a plurality of pixels that are arranged in a matrix form at intersections (or crossing regions) of data lines, scan lines, and power lines. The pixels generally include an OLED, two or more transistors including a driving transistor, and one or more capacitors.

Such an organic light emitting display device's power consumption is low, but the current flowing in the OLED is changed depending on a deviation of the threshold voltage of the driving transistor included in each of the pixels, thus causing a non-uniform display. That is, the characteristics of the driving transistors are changed depending on manufacture process variables of the driving transistor provided at each of the pixels. It is difficult to manufacture the organic light emitting display device at the present stage such that all the transistors thereof have the same characteristics. This causes the deviation of the threshold voltages of the driving transistors.

In order to overcome the problems, there has been proposed a method in which a compensation circuit having a plurality of transistors and capacitors is added to each of the pixels. The compensation circuit included in each of the pixels performs the charging of a voltage that corresponds to the threshold voltage of the driving transistor during one horizontal period, thus compensating for the deviation of the driving transistor.

Recently, in order to implement a motion blur and/or 3D display, a driving method using the driving frequency of 120 Hz or more is used. However, in the case of performing the high-speed driving of 120 Hz or more, the period of charging the threshold voltage of the driving transistor is shortened, so that it is very difficult to compensate for the threshold voltage of the driving transistor.

In the organic light emitting display device and the driving method thereof according to embodiments of the present invention, the display area comprises at least one block, and the pixels included in the block compensate for the threshold voltage of the driving transistor during the same period of time. When the threshold voltage of the driving transistor included in each of the pixels is concurrently (e.g., simultaneously) compensated for, a time to compensate for the threshold voltage is decreased (e.g., minimized), so that it is possible to stably compensate for the threshold voltage of the driving transistor. Further, according to embodiments of the present invention, it is possible to change the sequence of providing the scan signal based on (e.g., after) at least one frame, thus enabling an approximately (or substantially) uniform image to be displayed.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display device comprising:

pixels at crossing regions of scan lines and data lines;

i (i is a natural number of 2 or more) blocks divided such that each of the blocks includes two or more scan lines;

a control driver configured to supply a first control signal to i first control lines coupled, respectively, to the i blocks, and to supply a second control signal to i second control lines coupled, respectively, to the i blocks;

a scan driver configured to supply scan signals to the scan lines; and a data driver configured to supply a data signal to the data lines, wherein the scan driver comprises i block drivers to supply the scan signals on a block-by-block basis, a sequence of supplying the scan signals being such that the scan signals are supplied alternately in a first direction and a second direction that is different from the first direction;

wherein each of the block drivers comprises:

stages coupled, respectively, to ones of the scan lines included in an associated block of the blocks;

a first switch coupled between a first output terminal of a last stage included in the associated block and a second output terminal coupled to a next block of the blocks;

a second switch coupled between a first input terminal of a first stage included in the associated block and a second input terminal coupled to a previous block of the blocks;

a third switch coupled between the second output terminal and a first output terminal of the first stage; and a fourth switch coupled between the second input terminal and a first input terminal of the last stage.

2. The organic light emitting display device as claimed in claim 1, wherein the first direction corresponds to a direction from a top to a bottom of each of the blocks, and the second direction corresponds to a direction from the bottom to the top of each of the blocks.

3. The organic light emitting display device as claimed in claim 1, wherein the scan driver is configured to control the sequence of supplying the scan signals based on one or more frames.

4. The organic light emitting display device as claimed in claim 1, wherein the scan signals are concurrently supplied on the block-by-block basis, and supply of the scan signals is sequentially interrupted.

5. The organic light emitting display device as claimed in claim 4, wherein the supply of the scan signals on the block-by-block basis is interrupted in a sequence of the first direction or the second direction.

6. The organic light emitting display device as claimed in claim 1, wherein the first switch and the second switch are concurrently turned on or off, and the third switch and the fourth switch are concurrently turned on or off, and an ON period of the first switch does not overlap an ON period of the third switch.

7. The organic light emitting display device as claimed in claim 1, wherein the first switch and the second switch are turned on when the supply of the scan signals is interrupted in the first direction, and the third switch and the fourth switch are turned on when the supply of the scan signals is interrupted in the second direction.

8. The organic light emitting display device as claimed in claim 1, wherein the control driver and the scan driver are integrated into one driver, and each of the block drivers further comprises a first control stage and a second control stage for generating the first control signal and the second control signal, respectively.

9. The organic light emitting display device as claimed in claim 1, wherein the control driver is configured to sequentially supply the first control signal to the i first control lines, and to sequentially supply the second control signal to the i second control lines in such a way as to overlap the first control signal during a period.

10. The organic light emitting display device as claimed in claim 9, wherein the scan signals are set to a voltage at which a transistor in each of the pixels is turned on, and the first control signal and the second control signal are set to voltages at which transistors in each of the pixels are turned off.

11. The organic light emitting display device as claimed in claim 9, wherein the first control signal is supplied to an i-th block after the scan signals have been concurrently supplied to scan lines at the i-th block, the second control signal is supplied to the i-th block after the first control signal has been supplied, and supply of the second control signal is interrupted after supply of the first control signal has been interrupted.

12. The organic light emitting display device as claimed in claim 11, wherein the data driver is configured to supply the data signal to the data lines during a period when the first control signal overlaps the second control signal, and to supply a reference power as the data signal during a remaining period.

13. The organic light emitting display device as claimed in claim 1, wherein at least one pixel at each of the blocks comprises:

an organic light emitting diode;

a first transistor configured to control a current that is supplied to the organic light emitting diode from a first power source coupled to a first electrode of the first transistor, in response to a voltage applied to a first node;

a second transistor coupled between the first node and a corresponding one of the data lines, and configured to be turned on when a corresponding one of the scan signals is supplied;

a third transistor coupled between the first electrode of the first transistor and the first power source, the third transistor configured to be turned off when the first control signal is supplied and to be turned on in other cases;

a fourth transistor coupled between a second electrode of the first transistor and an anode electrode of the organic light emitting diode, the fourth transistor configured to be turned off when the second control signal is supplied and to be turned on in other cases;

a fifth transistor coupled between the anode electrode of the organic light emitting diode and an initialized power source, and configured to be turned on when the corresponding one of the scan signals is supplied; and a first capacitor and a second capacitor coupled in series between the first node and the first power source, wherein a second node that is a common terminal of the first and second capacitors is electrically coupled to the first electrode of the first transistor.

14. A method of driving an organic light emitting display device comprising i (i is a natural number of 2 or more) blocks, each of the blocks comprising a plurality of pixels, the method comprising:

concurrently compensating for a threshold voltage of a driving transistor at each of the pixels of each of the blocks;

supplying scan signals from a scan driver to each of the blocks;

storing a voltage corresponding to a data signal in the pixels of each of the blocks; and emitting light from the pixels of each of the blocks, wherein the scan signals are supplied to the blocks alternately in a first direction and a second direction that is different from the first direction, wherein the scan driver comprises i block drivers to supply the scan signals, and wherein each of the block drivers comprises:

stages coupled, respectively, to scan lines included in an associated block of the blocks;

a first switch coupled between a first output terminal of a last stage included in the associated block and a second output terminal coupled to a next block of the blocks;

a second switch coupled between a first input terminal of a first stage included in the associated block and a second input terminal coupled to a previous block of the blocks;

a third switch coupled between the second output terminal and a first output terminal of the first stage; and a fourth switch coupled between the second input terminal and a first input terminal of the last stage.

15. The method as claimed in claim 14, wherein the first direction corresponds to a direction from a top to a bottom of each of the blocks, and the second direction corresponds to a direction from the bottom to the top of each of the blocks.

16. The method as claimed in claim 15, wherein a sequence of supplying the scan signals is changed to the first direction and the second direction based on one or more frames.

17. The method as claimed in claim 14, wherein the scan signals are concurrently supplied to scan lines included in each of the blocks, and supply of the scan signals is sequentially interrupted.

* * * * *